United States Patent [19]

Schumacher

[11] Patent Number: 4,657,093

[45] Date of Patent: Apr. 14, 1987

[54] ROLLING CUTTER DRILL BIT

[75] Inventor: Percy W. Schumacher, Houston, Tex.

[73] Assignee: Reed Rock Bit Company, Houston, Tex.

[21] Appl. No.: 345,468

[22] Filed: Feb. 3, 1982

Related U.S. Application Data

[63] Continuation of Ser. No. 132,951, Mar. 24, 1980, abandoned.

[51] Int. Cl.[4] ..... E21B 10/08

[52] U.S. Cl. ..... 175/353

[58] Field of Search ..... 175/353

[56] References Cited

U.S. PATENT DOCUMENTS

| | | | |
|---|---|---|---|
| 2,038,386 | 4/1936 | Scott et al. | 175/353 |
| 2,147,926 | 2/1939 | Scott | 175/353 |
| 2,148,372 | 2/1939 | Garfield | 175/353 |
| 2,463,932 | 3/1949 | Zublin | 175/353 |
| 2,571,930 | 10/1951 | Noble | 175/353 |
| 3,495,668 | 2/1970 | Schumacher, Jr. | 175/353 |
| 3,696,876 | 10/1972 | Ott | 175/353 |

OTHER PUBLICATIONS

"A Study to Determine the Optimum Bit Offset at Various Drilling Depths", by Terra Tek, Inc.—Oct., 1978-DOE.

"Rotary Drill Bit/Rock Model with Cutter Offset", by E. I. Umez-Eronini.

*Primary Examiner*—James A. Leppink
*Assistant Examiner*—Hoang C. Dang
*Attorney, Agent, or Firm*—Carl A. Rowold

[57] ABSTRACT

This invention discloses a rolling cone drilling bit having a plurality of cutters which have inserted therein hard metal cutting elements preferably formed of tungsten carbide alloy; and in which bit the rolling cone cutters are located in such a manner that their rotational axes are greatly offset from the rotational axis of the drill bit. In addition, a fluid jetting system is provided in the invention that directs a pressurized fluid spray across the main cutting inserts and against the formation face so that when the drill bit is used in its most advantageous areas, such as the soft, medium-soft and plastic formations, the jetting system prevents "balling up" of the cutters and greatly increases the drilling efficiency of the bit.

6 Claims, 14 Drawing Figures

ROLLING CUTTER DRILL BIT

This is a continuation of application Ser. No. 132,951, filed Mar. 24, 1980, now abandoned.

BACKGROUND OF THE INVENTION

In the drilling of boreholes through underground formations for the purposes of locating and producing oil and gas, and for the purposes of mining and production of steam energy through thermal wells, the most common type of drilling apparatus used today is the tri-cone rolling cutter drill bit. This bit generally comprises a central body section having three legs extending downwardly therefrom. Each leg has an inwardly projecting bearing journal upon which is rotatably mounted a frustoconical cutter. Generally, the most prevalent type of cutting structure utilized in the tri-cone bit is the tungsten carbide insert cutting structure. Tungsten carbide cutting elements are press-fit in holes drilled in the frustoconical cutters and protrude outwardly to provide a digging, crushing and gouging action on the bottom of the borehole as the bit is rotated.

The tungsten carbide insert bit has generally been known and used for approximately the last 30 years. For the first 20 years (1950 to about 1970), those in the art felt that the cutting structure of the insert bit should be of the nonoffset or "true rolling cone" type. The offset, which is defined as the amount by which the rotational axes of the rolling cutters is offset from the rotational axis of the main bit, was a feature found in milled tooth bits but believed to be detrimental to insert bits because of the breakage problem in the tungsten carbide inserts when the additional drag forces were introduced through the use of offset.

In February, 1970, a new bit design was patented by P. W. Schumacher, Jr. (U.S. Pat. No. 3,495,668) in which, for the first time, an insert bit successfully incorporated offset axis cutters to achieve greater gouging and scraping action in the borehole. A subsequent patent, U.S. Pat. No. 3,696,876, issued to Ott in October, 1972, also disclosed a similar invention wherein offset axis cutting elements were incorporated into an insert bit.

Drilling bits incorporating the novel combination of offset cutters and tungsten carbide inserts were successfully introduced by the assignee of the present invention, Reed Rock Bit Company, in 1970, and have become the most prevalent type of drill bits in the drilling industry over the past ten years. This second generation of drill bits utilizing offset axes and tungsten carbide inserts are particularly advantageous in soft to medium-soft formations by reason of their introduction of a gouging and scraping action which enhances the drilling efficiency and rate of penetration of the bit in these formations. The amount of offset utilized in these bits ranges on the order of from about 1/64 to about 1/32 inch offset per inch of drill bit diameter. For instance, a $7\frac{7}{8}$ inch bit having offset would have from $\frac{1}{8}$ inch to $\frac{1}{4}$ inch total offset in the cutters.

Conventional drilling bits currently on the market are limited in the amount of offset introduced into the cutters to about 1/32 inch of offset per inch of diameter. Thus, the maximum amount of offset utilized in these soft formation bits currently runs about $\frac{1}{4}$ inch in a $7\frac{7}{8}$ inch diameter bit. During this ten year period when offset axis insert bits have been made commercially successful, those skilled in the art of drill bit technology generally have followed the principle that any additional offset in the cutters above about 1/32 inch per inch of bit diameter would not add any significant efficiency or increased drilling rate to the bit to justify the increased breakage that such increased offset would introduce. In fact, drilling tests conducted utilizing insert bits with offset somewhat greater than 1/32 inch per inch of bit diameter have indicated insignificant gains in rate of penetration, but larger incidences of insert breakage. Thus, those skilled in the art have restricted their insert bit designs to having an offset range of from zero to 1/32 inch per inch of bit diameter.

The present invention utilizes a unique insert bit design having great amounts of offset in the cutting structure far exceeding those ranges utilized in conventional offset-axis insert bits. It was found by this inventor that when offset equal to or greater than 1/16 inch per inch of bit diameter was introduced into a tri-cone insert bit, that greatly significant increases in rate of penetration and bit performance can be obtained. For some reason unknown to the inventor, the penetration rate and drilling efficiency of an offset insert bit does not increase significantly from about 1/32 inch offset per inch of bit diameter (upper range of conventional insert offset bits) up to about 1/16 inch offset per inch of bit diameter. It was discovered though that beginning at about 1/16 inch offset per inch of bit diameter a significant jump in the rate of penetration and drilling efficiency was noted.

The use of large amounts of offset in milled-tooth rolling cutter drill bits may not in itself be a novel concept. For instance, see U.S. Pat. no. 1,388,456 to H. W. Fletcher, dated Aug. 23, 1921, in which a two-cone rolling cutter drill bit having milled tooth cutters apparently incorporated a large amount of offset in the two cutters. The patent discloses no specific amount of offset to be utilized and, as far as this inventor is aware, no commercial embodiment of the Fletcher design ever became successful. The conventional milled tooth drill bits which have been available for the last 40 years have generally utilized offset in the range of 1/64 to 1/32 inch per inch of bit diameter and have been tri-cone bits. It was not until 1970, and the issuance of the Schumacher patent, that the industry was introduced to the use of insert type bits utilizing the offset already present in milled tooth bits. The reason that the high offset cutters were not thought practical was that increases in offset above the 1/32 inch limit previously mentioned would gain very little in cutting efficiency, but increased the amount of breakage of tungsten carbide inserts in the insert type bits. Also, increasing the offset necessarily requires reducing the size of the cutter cones to prevent interference between the inserts on adjacent cones. Smaller cones mean smaller bearing areas and/or thinner cone shells, both of which add to earlier bit failure. Also, greater offset means less efficient intermeshing of inserts on adjacent cones which in turn reduces the amount of self-cleaning of the inserts and increases "balling-up".

Conventional jetting systems are generally made up of two different types. The oldest type is the regular drilling fluid system where large, relatively unrestricted fluid openings are provided in the bit body directly above the cutter cones to allow a low pressure flow of the drilling fluid to fall on the cones and move around the cones to the bottom of the borehole. By necessity, this is a low-volume, low-velocity flow since the fluid stream impinges directly upon the cutter face, and abrasion of the cones is a serious problem under these circumstances. The second type of conventional bit fluid system comprises the "jet" bits. In a jet bit a high pressure jet of fluid is generated from the bit body directly against the formation face without impinging on any cutting elements or any portion of the bit. In some instances, the so-called jet bits have fluid nozzles extending from the bit bodies all the way downward to a point only a fraction of an inch above the formation face to maximize hydraulic energy of the fluid stream impinging the formation face. The conventional jet bits do not emit fluid against any cutting elements because of the adverse effect of erosion from the high-pressure drilling fluid. The present invention differs from these two conventional types in that it uses a directed jet spray which impinges directly upon the cutter inserts.

The present invention discloses an insert type bit, as opposed to a milled tooth bit, which insert bit utilizes rolling cone cutting elements rotatably mounted on lugs having rotational axes with large offset from the rotational axis of the drill bit. The amount of offset ranges between 1/16 and ⅛ inch per inch of bit diameter. The resulting invention produces greatly increased rates of penetration and drilling efficiency when utilized in soft to medium-soft formations. It should be noted that the present invention, when embodied in a tri-cone oilwell drilling bit, suffers a greater amount of erosion and breakage of the hard metal cutting inserts in the cones, but the total gain in drilling efficiency and rate of penetration far offsets the increased wear and breakage of the cutting elements.

In addition to the aforementioned unique drill bit construction, the present invention also embodies a new and unique nozzle jetting system for delivering drilling fluid to the cutting elements and the face of the formation as it is being drilled. This jetting system utilizes directed nozzles which create a spray of pressurized drilling fluid and directs this spray across the protruding tungsten carbide inserts and against the formation face. The new jetting system provides a dual function of cleaning material from the inserts and also sweeping the cuttings fromm the borehole face. This system is particularly advantageous when drilling through those certain types of formations which, because of their softness or ductility, become very plastic during drilling operations, and tend to "ball up" in the spaces between the inserts on the cutters. This "balling up" greatly reduces the rate of penetration and the cutting efficiency of drill bits when penetrating such plastic formations. The new jetting system provides a plurality of fluid jets directed at preselected angles to spray drilling fluid across the inserts without impinging the cutter cone surfaces, with the spray also being directed against the formation face to further flush and clean the cuttings as they are gouged and scraped out of the formation.

BRIEF DESCRIPTION OF THE DRAWINGS

FIG. 7 is an axial end-view of a central nozzle system, and FIG. 8 is a partial cross-sectional side view of the nozzle of FIG. 7.

DESCRIPTION OF THE PREFERRED EMBODIMENTS

Figure 1:
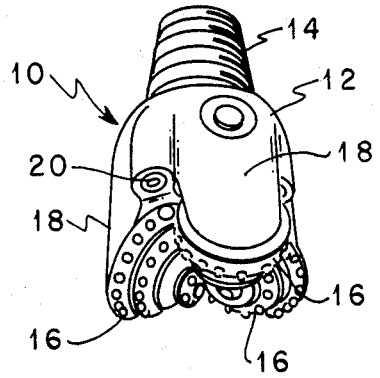
FIG. 1 is a side view of one embodiment of the present invention comprising a three-cone bit.
Figure 2:
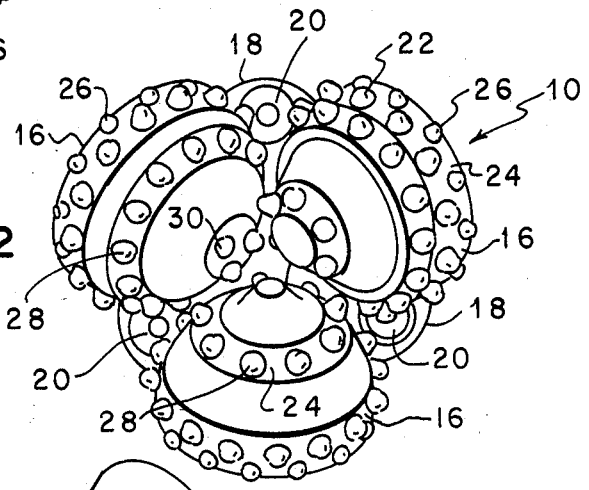
FIG. 2 is an axial bottom view of the three-cone bit of FIG. 1.

Referring to FIG. 1, a first embodiment of the invention shown in isometric view, this embodiment comprises a tri-cone drilling bit 10 having a central main body section 12 with an upwardly extended threaded pin end 14. The threaded pin 14 comprises a tapered pin connection adapted for threadedly engaging the female end of a section of drill stem. The body section 12 has three downwardly extending legs 18 formed thereon, each of which contains a rotatably mounted frustoconical cutter 16. A plurality of nozzles 20 may be located in the periphery of the body section 12 aimed downward past cutters 16. In FIG. 2, which is an axial view looking up from the borehole toward the bottom of the bit, the cutters 16 of bit 10 are shown with hard metal cutting elements 22 projecting from raised lands 24 formed on the surfaces of the cones. In a typical embodiment the inserts generally would comprise three different categories, the gauge row inserts 26, intermediate row inserts 28, and nose inserts 30. As is well known in the industry, the inserts are secured in the cones by drilling a hole in the cone for each insert with the hole having a slightly smaller diameter than the insert diameter, thus resulting in an interference fit. The inserts are then pressed under relatively high pressure into the holes and the press fit insures that the inserts are securely held in the cones.

Although not shown in the drawings, each cutter 16 is rotatably mounted on a cylindrical bearing journal machined on each leg 8, as is well known in the art. As is also well known in the art, bearings such as roller bearings, ball bearings, and/or sleeve bearings are located between the cutter and the bearing journal to provide the rotational mounting. In one preferred embodiment, cutters were mounted on bearing journals with sleeve bearings and ball bearings therebetween as illustrated in the Henry W. Murdoch patents, U.S. Pat. No. 3,990,751 and U.S. Pat. No. 4,074,922, granted Nov. 9, 1976, and Feb. 21, 1978, respectively, and assigned to Reed Tool Company of Houston, Tex.

Figure 3:
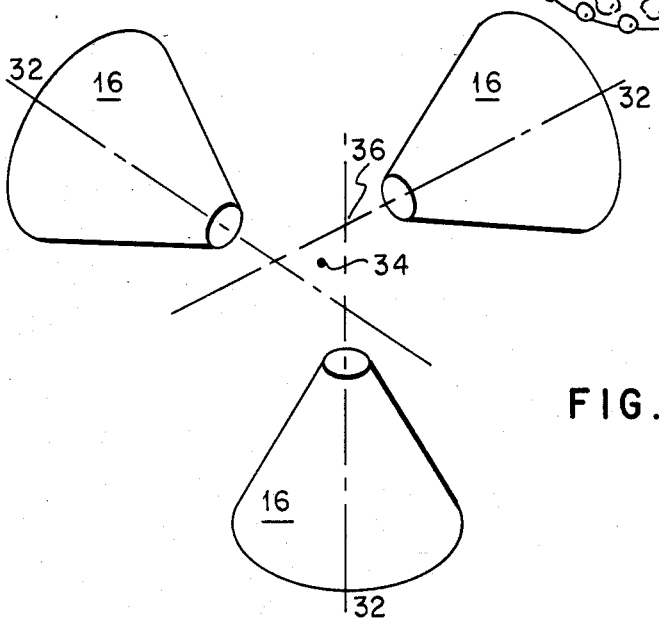
FIG. 3 is a schematic representation of the three cutter cones of the bit of FIGS. 1 and 2, showing the concept of offset cutter axes.

In FIG. 3, the cutters 16 are illustrated schematically as simple frustoconical figures. Each cutter cone 16 has an axis of rotation 32 passing substantially through the center of the frustoconical figure. The central rotational axis of the bit 10 is illustrated as point 34 in FIG. 3 since FIG. 3 is taken from a view looking directly along the rotational axis of the bit. From FIG. 3, it can be seen that because of the offset of axes 32, none of the axes intersect axis 34 of the bit. In this flat projection, the intersection of the axes 32 forms an equilateral triangle 36. The amount of offset measured in a linear distance for any particular bit can be determined from a full scale diagram similar to FIG. 3 for that bit by measuring the distance from axis 34 to the mid-point of any side of triangle 36.

Figure 4:
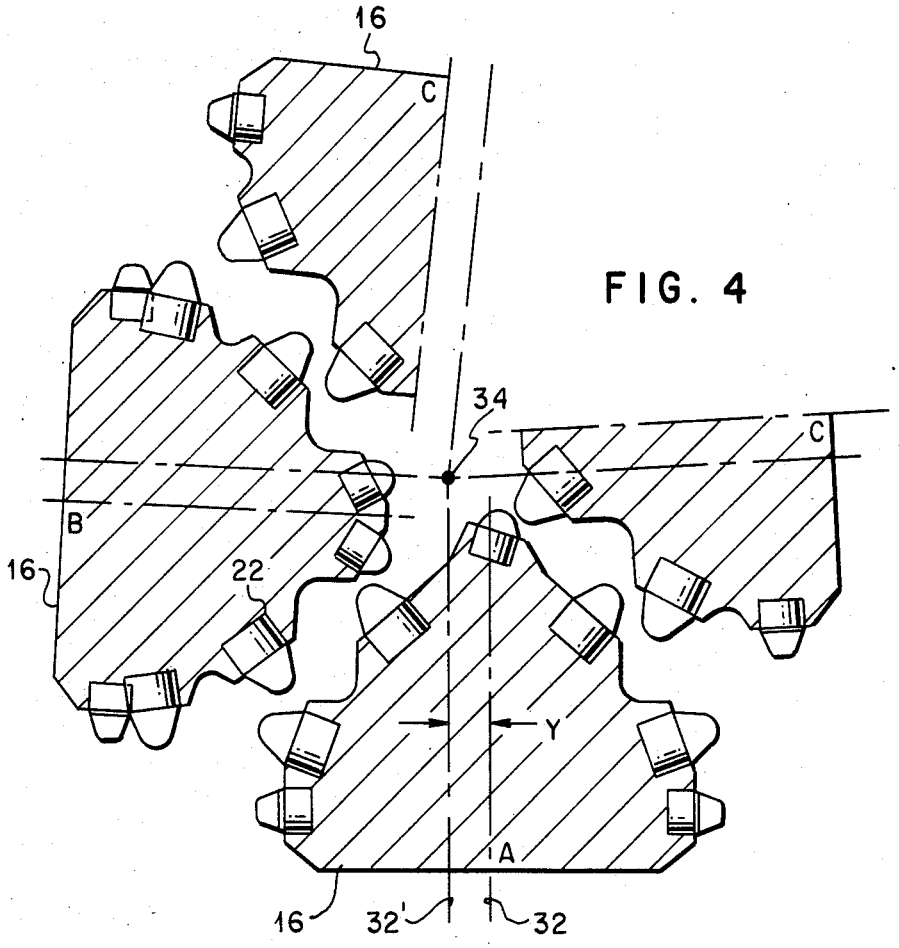
FIG. 4 is a diagram of the cutter configuration in one embodiment of the invention illustrating the location and placement of the inserts in the cutter and also indicating the offset of the cutters.

Referring now to FIG. 4, in which a cutter layout is illustrated, the profiles or cross-sections of each of the cutters of the tri-cone bit of the preferred embodiment are layered out in relation to each other to show the intermesh of the cutting elements or inserts 22. Generally, each cutter in a tri-cone bit is of a slightly different profile in order to allow optimum spacing of the inserts for the entire bit. In FIG. 4, the three cutters are labeled A, B and C. The C cutter has been divided to illustrate its intermesh with both cutters A and B. It should be noted that the projections have been flattened out, and because of the two-dimensional aspect of this relationship, a distortion in the true three dimensional relationship of the cutters is necessary. In FIG. 4, the central axis of rotation 34 of the bit is indicated. Each cutter A, B and C, has a rotational axis 32 which is offset by a distance Y from an imaginary axis 32' which is parallel to the actual axis 32 and passes through point 34 which is the bit rotational axis.

Figure 5:
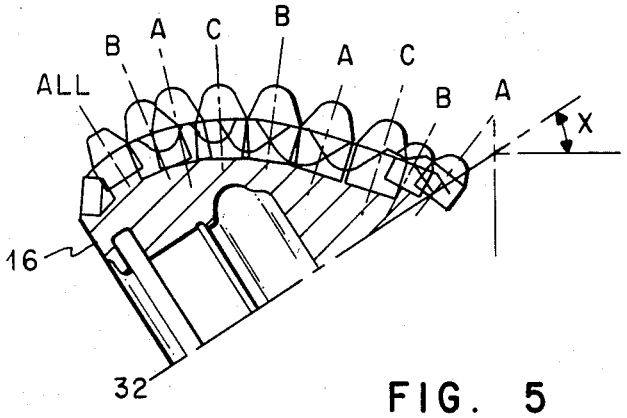
FIG. 5 is a schematic diagram showing an overlay of the insert pattern of all three cutters of FIG. 4 to show bottom hole coverage of the bit.

FIG. 5 is a cutter profile which is an overlay of one-half of each of the cutters A, B and C to indicate the placement of all of the inserts with respect to bottom hole coverage. Each insert in the profile of FIG. 5 is labeled according to the particular cutter cone in which the insert is located. The angle X is indicated to show the journal angle of the bit. The journal angle is the angle that the bearing journal axis, which coincides with the rotational axis 32 of the cutter, makes with a plane normal to the bit rotational axis 34.

In this particular embodiment it was found that the preferred range of insert protrusion above the cutter surface should be greater than or equal to about one-half the diameter of the insert. Any protrusion significantly less than one-half the diameter would make the gouging and scraping action resulting from the large amount of offset ineffective. The preferred range of insert protrusion is from one-half to one times the insert diameter. The preferred shape of the protruding portion of the insert is conical or chisel. Acceptable alternate shapes are the hemispherical and the sharpened hemispherical inserts.

Whereas the insert can be made of any hard metal alloy such as titanium carbide, tantalum carbide, or chromium carbide, in a suitable matrix, one particular range of embodiments utilizes tungsten carbide in a cobalt matrix. The cobalt content ranges from about 5% to about 20% by weight of the insert material, with the remainder of the metal being either sintered or cast tungsten carbide, or both. The hardness of the inserts is controlled by varying the cobalt content and by other well-known methods. The hardness ranges from about 85 Rockwell A to about 90 Rockwell A. In one particular embodiment, conical inserts having a protrusion greater than one-half of their diameter were used, with the inserts being made of tungsten carbide-cobalt alloy, having a cobalt content of around 12% and a hardness of about 86.5 Rockwell A.

Figure 6:
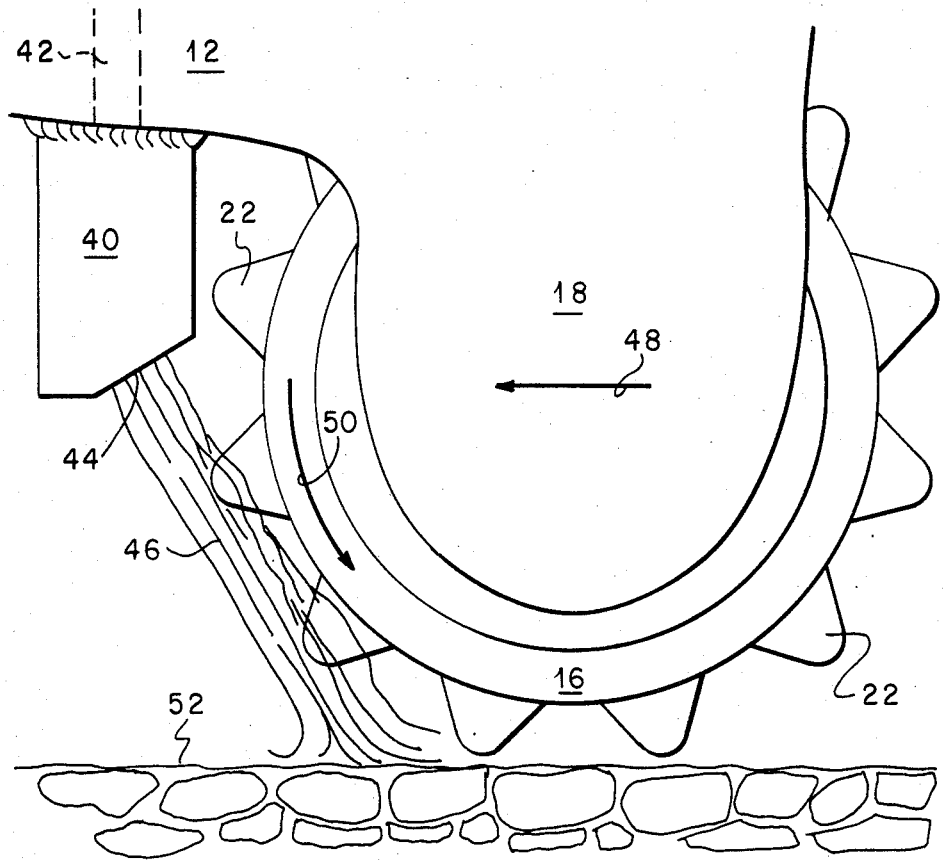
FIG. 6 is a schematic illustration of one embodiment of this invention indicating the directed nozzle system and its interraction with the cutter and the formation.

Referring now to FIG. 6, a schematic sketch of the directed nozzle fluid system of the invention is illustrated. In FIG. 6, a generally cylindrical jet nozzle 40 is shown connected to bit body 12 and communicating with a high pressure rilling fluid passage 42 passing therethrough. Nozzle 40 has an exit jet 44 from which high pressure drilling fluid 46 is emitted in a tight directed spray. Bit leg 18 is illustrated having conical cutter 16 located thereon. A direction arrow 48 is drawn on leg 18 to indicate the direction of movement of the bit leg in the borehole as the drill bit is rotated. Likewise, a second rotation arrow 50 is drawn on cutter 16 to indicate the simultaneous rotation of cutter 16 with movement of bit 10 in the borehole. The high-pressure drilling fluid stream 46 is directed in a closely controlled direction such that the fluid stream is either exactly tangent with the surface of cutter 16 or slightly displaced therefrom as shown in the drawing. The placement of stream 46 in a tangential relationship with cutter 16 allows effective cleaning of inserts 22 as they move through stream 46, but also prevents abrasive erosion of the cutter shell 16 which would occur if 46 impinged squarely thereon. Although the preferred embodiment is to have stream 46 either tangential to or slightly displaced from cutter shell 16, a slight impingement of 46 with cutter shell 16 would not be highly detrimental due to the very slight angle of incidence of stream 46 against the cutter surface. As fluid stream 46 passes over inserts 22 and close to cutter shell 16, it dislodges material built up between inserts 22 and drives it downward with the motion of the cutter 16. After the fluid passes the inserts it impinges the bottom 52 of the borehole and travels along the bottom picking up cuttings as they are chipped and gouged from the formation by inserts 22. The drilling fluid then passes below the cutter 16 and moves back upward outside the drill bit and up through the borehole in the conventional manner.

Figure 7:
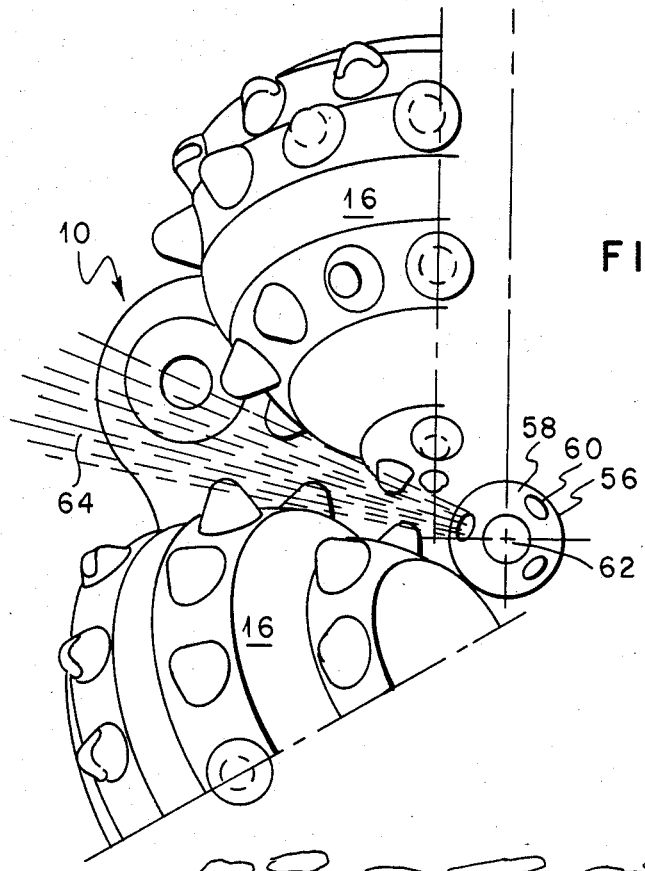
FIGS. 7 and 8 are illustrations of a particular embodiment of the directed nozzle system shown schematically in FIG. 6.
Figure 8:
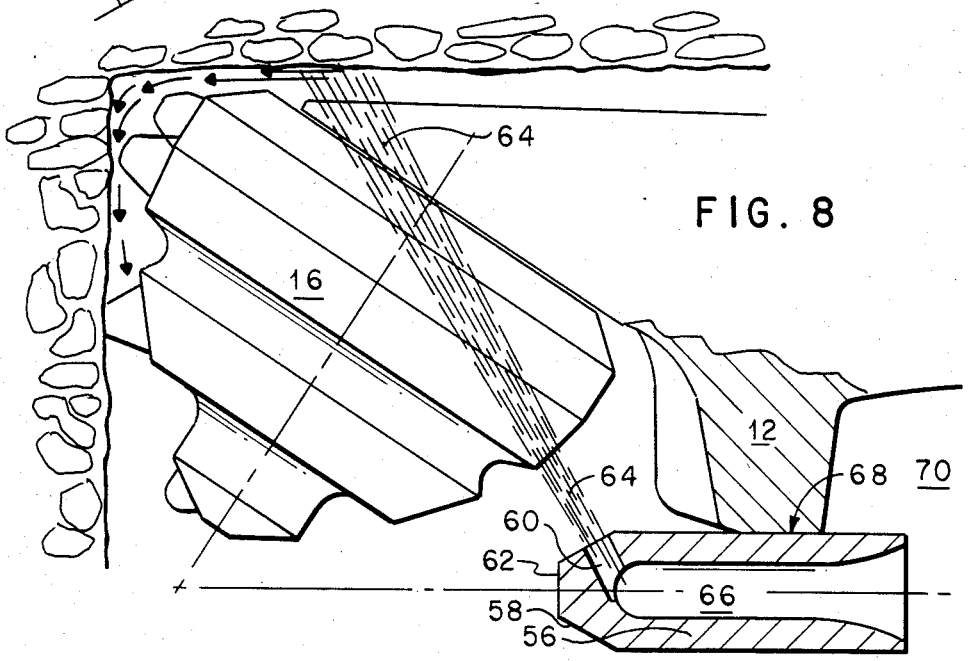

Referring now to FIGS. 7 and 8, one embodiment of the directed jetting system is disclosed. This embodiment utilizes a multi-orifice jet nozzle which protrudes downwardly from the central area of the bit body towards the central area between the three conical cutters. FIG. 7 is a partial axial end-view of the bit 10 partially illustrating two cutters 16 and the location of the multi-orifice jet 56. Jet 56 is generally cylindrical in nature having a bevelled edge 58 at the downward projecting end thereof and having three nozzle openings 60 formed through the bevelled surface 58. A flat, closed end 62 is located at the bottom of the nozzle. A fluid spray 64 is shown emanating from one of the openings 60. This spray passes across the inserts in the cutters 16 without impinging on the actual cutter surfaces. The spray cleanses any packed cuttings which might be lodged between the various inserts and then moves outward and then downward to sweep the bottom of the borehole in front of the cutters as they roll into the formation surface. FIG. 8 is a partial side view of the bit of FIG. 7 showing a single cutter 16 and the multi-jet nozzle 56. In this figure, the nozzle 56 is shown in a cross-sectional diagram and it can be seen that the nozzle has a central passage 66 which communicates with the nozzle openings 60. Nozzle 56 is securely located in a bore 68 formed in bit body 12. Bit body 12 has a fluid cavity 70 formed therein which communicates with threaded pin end 14 which also is tubular in nature. Thus, it can be seen that drilling fluid pumped down the drill string passes through threaded pin 14 into bit cavity 70, through nozzle bore 66 and out the nozzle opening 60 into a jet or spray 64 which impinges the major cutting inserts on cone 16 and then is directed either against the face of the borehole or, as shown in 8, may be directed against the wall of the borehole whereupon the fluid moves down the wall and across the formation face to pick up additional loose cuttings thereon.

Figure 9:
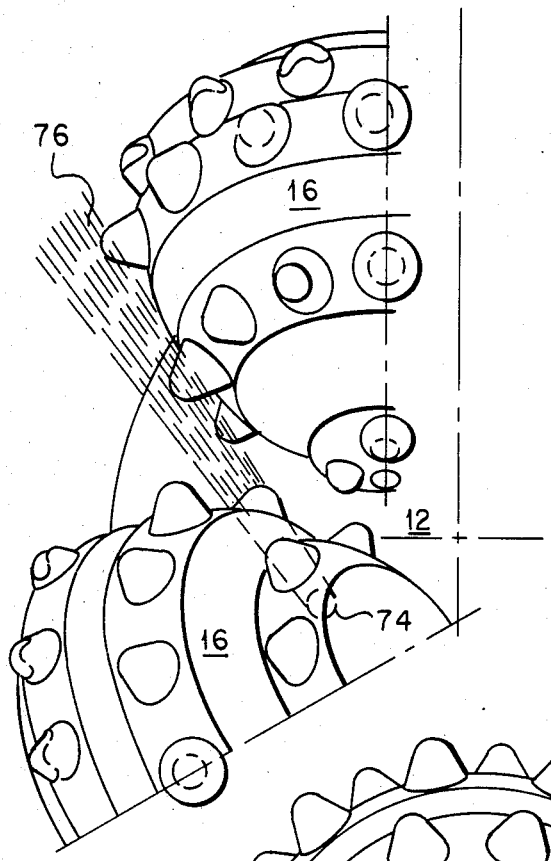
FIGS. 9 through 11 are different views of a second embodiment of the directed nozzle system utilizing an intermediate jet.
Figure 10:
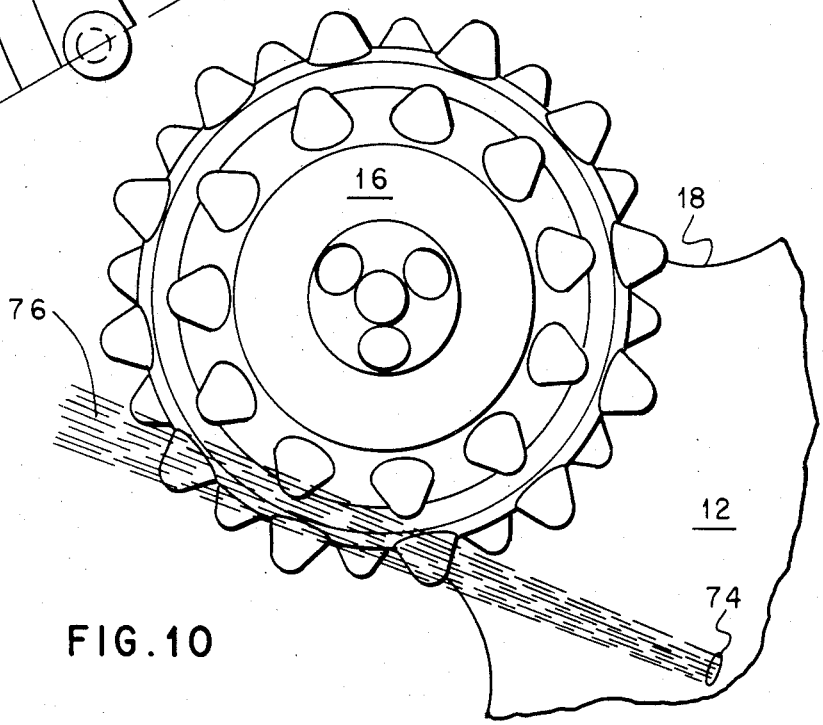
Figure 11:
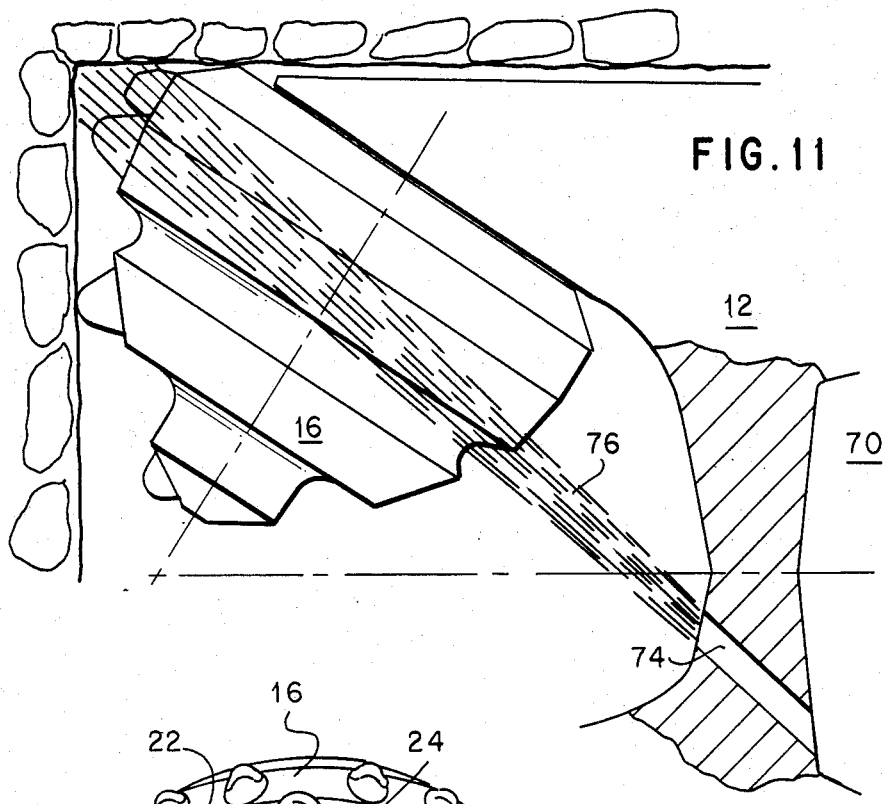

Referring now to FIGS. 9 through 11, a second embodiment of the directed nozzle system is disclosed in which the fluid jetting system is directed across the main cutting inserts and impinges directly upon the borehole face. In this embodiment, the projected nozzle arrangement is replaced by a slanted jet configuration formed through the wall of the bit body 12 and communicating with bit cavity 70. FIG. 9 is a partial axial view showing part of two cutter cones 16, the bit body 12 and a directed jet passage 74. The drilling fluid is emitted from jet passage 74 in a stream 76 which impinges the major cutting inserts in cones 16 and passes downward to impinge the bottom of the borehole. In this embodiment three of the jet passages 74 are formed in bit body 12 so that each conical cutter 16 has one jet passage associated therewith for sweeping cuttings from the inserts and impinging the bottom of the borehole. FIG. 10 is a side view of one cutter looking from the central axis of the bit radially outward at the cutter. Jet passage 74 passes through bit body 12, communicating with the drilling fluid in the drill string by means of cavity 70 and pin 14. FIG. 11 is a partial side schematic view of the cutter 16 of FIG. 10 rotated approximately 90 degrees. In FIG. 11 one of the three jet passages 74 is shown in communication with cavity 70 and emitting a jet stream 60 of drilling fluid passing across the cutting inserts of cutter 16 and impinging the borehole bottom.

Figure 12:
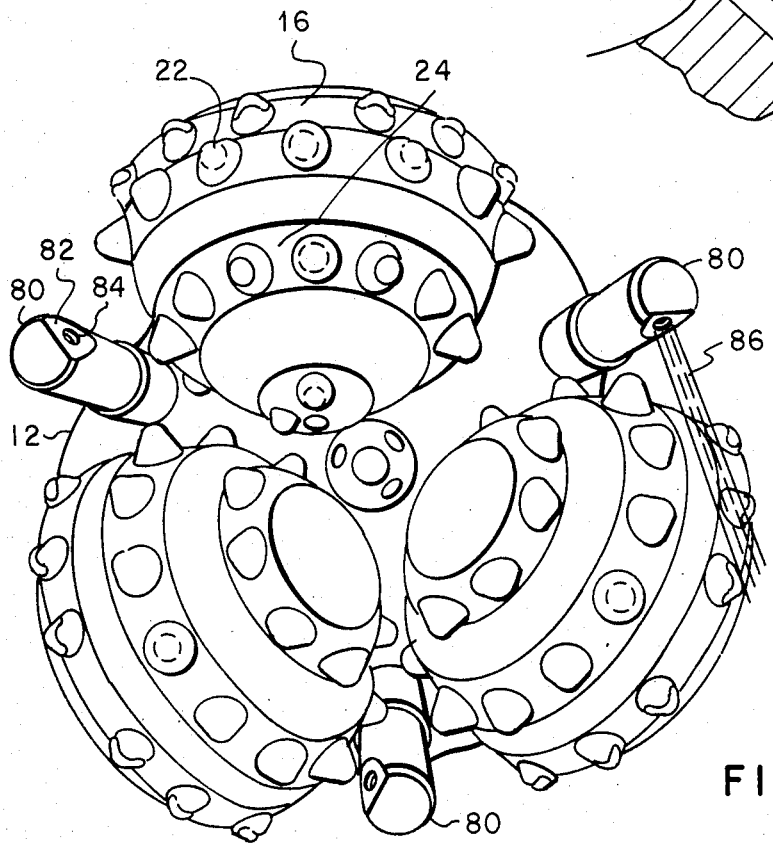
FIGS. 12 through 14 illustrate axial bottom views of a third embodiment of the present invention which utilizes a peripheral directed nozzle system.
Figure 13:
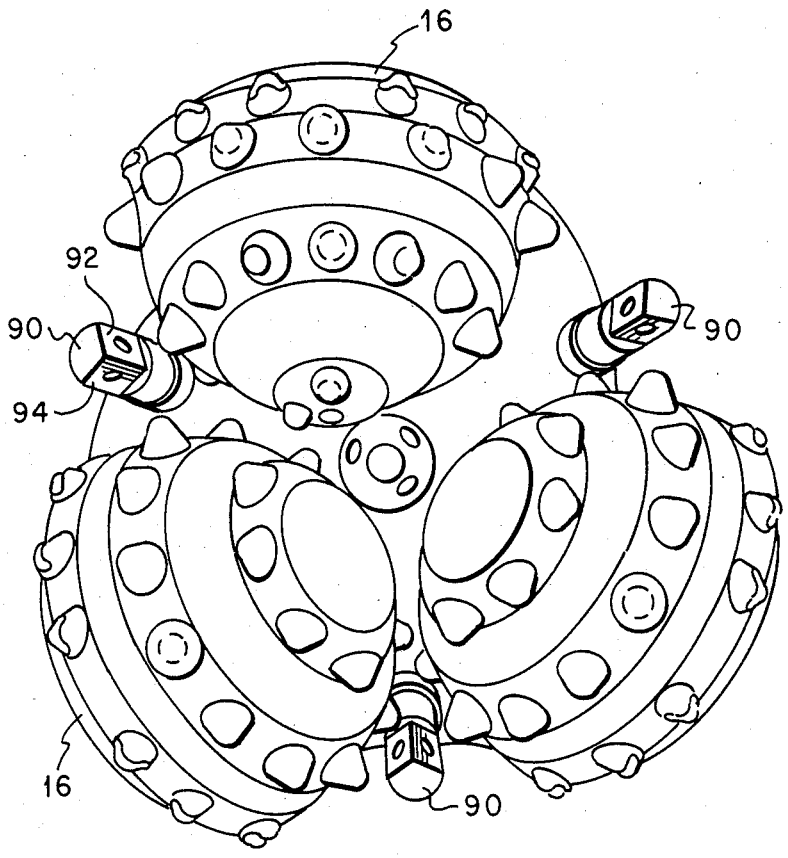
Figure 14:
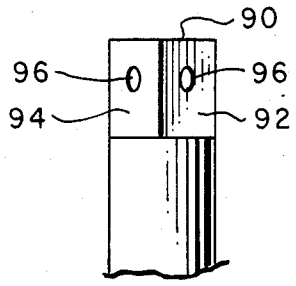

Referring to FIGS. 12 through 14, two additional embodiments of the present invention with the directed nozzle system are indicated. In FIG. 12 a drill bit is shown in the axial view looking up from the bottom of the borehole. The bit has three conical cutters 16 having a plurality of tungsten carbide inserts 22 securely held in raised lands 24 on the cutters. A set of three peripherally directed nozzles 80 are located around the outer periphery of bit body 12, extending downward therefrom into the generally open areas between the outer rows of inserts on the conical cutters. The embodiment of FIG. 12 utilizes the three directed nozzles which are generally cylindrical in nature, each having a bevelled face 82 and a jet passage 84 formed through face 82 and communicating with a central bore passage in nozzle 80. Jet passage 84 is formed such that a directed spray of fluid 86 is emitted therefrom which impinges across the main cutting inserts of the conical cutters which are located clockwise from each nozzle 80. Each jet passage 84 is aimed in a generally circumferential direction with respect to bit body 12 and in a tangential direction to cutter cones 16 such that the fluid spray emitted therefrom does not impinge squarely on the cone 16. Each nozzle 80 having the single jet passage 84 is arranged to clean the inserts on the cutter located in a clockwise direction from the nozzle. After the spray passes across the main cutting inserts, it is directed against the bottom of the borehole to further provide cleaning action during the drilling operation. In FIG. 13, a slightly different embodiment of the peripheral nozzle system is disclosed in which three double jet nozzles 90 are located around the periphery of the bit bottom extending downwardly therefrom between the outer edges of the cones 16. Each nozzle 90 has two jet passages formed therein passing through opposed bevelled faces 92 and 94. Thus, each nozzle 90 has a jet passage directed at each cutter cone 16 located adjacent thereto. FIG. 14 is a diagramatic sketch showing the nozzle 90 from the side and illustrating the two bevelled faces 92 and 94. The jet passages 96 pass through the two bevelled faces and communicate with an inner bore in nozzles 90. Pressurized drilling fluid passes through the drill bit and into the nozzles 90 in a manner similar to that of the embodiment shown in FIG. 12.

The nozzles utilized in the embodiments illustrated in FIGS. 6 through 14 are preferably formed by casting, forging, and/or machining from a hard material such as steel or one of the hard metal alloys such as tungsten carbide in a cobalt matrix. The tungsten carbide-cobalt alloy can be of the type using sintered tungsten carbide, cast tungsten carbide, or a combination of both. Alternatively, the nozzles could be formed of any material which successfully resists erosion.

Thus, the present invention defines several unique features, one of which is the utilization of an extreme amount of offset in the cutter axes of an insert type bit. Another feature is the novel fluid jetting system which provides a highly efficient cleaning of the protruding inserts as well as a cleaning of the formation face as it is being drilled.

This system directs the high-pressure fluid jet at or near a tangent to the cutter cones in a position to sweep the main cutting inserts, thereby cleaning the balled up material therefrom, and the fluid stream thereafter passes from the insert region to the formation face directly, or from the insert region to the borehole wall and then down the wall and across the formation face.

Although certain preferred embodiments of the present invention have been herein described in order to provide an understanding of the general principles of the invention, it will be appreciated that various changes and innovations can be effected in the described drill bit structure without departure from these principles. For example, whereas a tri-cone bit having three conical cutters is disclosed, it is clear that the bit structure could be of the four-cone type, and still embody the principles of the present invention. Likewise, the number and location of the directed nozzles could be varied from those shown and still obtain equivalent operation, function, and results. Thus, all modifications and changes of this type are deemed to embraced by the spirit and scope of the invention except as the same may be necessarily limited by the appended claims or reasonable equivalents thereof.

The embodiments of the invention in which an exclusive property or privilege is claimed are defined as follows:

1. A rolling cutter drill bit for drilling through underground formations, said bit comprising:

a main body having an upper end adapted for interconnection in a drilling string;

a plurality of legs extending downwardly from said body, each having an inwardly projecting bearing journal formed thereon;

a generally frustoconical cutter rotatably mounted on each said bearing journal, having a rotational axis generally coinciding with the central axis of said journal, and having a plurality of hard metal cutting elements inserted therein and protruding from the surface thereof;

bearing means between each said cutter and bearing journal;

said drill bit having a cutting diameter defined by the radially outermost located of said cutting elements on each said cutter and having a bit rotational axis passing longitudinally therethrough; and, the central axes of said journals being offset from said bit axis by an amount ranging from about one-sixteenth inch per inch to about one-eighth inch per inch of bit cutting diameter.

2. The rolling cutter drill bit of claim 1 wherein said legs and cutters each number three and said cutting elements protrude at least one-half of the insert diameter from the cutter surface; said inserts being formed of a tungsten carbide-cobalt material wherein the cobalt content by weight ranges from about five percent to about twenty percent and the hardness of said insert is from about 85 Rockwell A to about 90 Rockwell A.

3. A tri-cone rolling cutter drill bit comprising:

a bit body having an upper threaded pin end for engaging a section of drill string, and further having an axis of rotation;

three downwardly extending, generally equispaced legs on said bit body, each having a cylindrical bearing journal extending radially inward and downwardly from the lower end thereof;

a generally frustoconical cutter rotatably mounted on each said bearing journal, and having a rotational axis generally coinciding with the central longitudinal axis of said journal;

bearing means between each said cutter and bearing journal;

a plurality of hard metal cutting elements inserted in each said cutter and protruding outwardly therefrom; and, wherein said cutter rotational axes are offset from said bit rotational axis by a distance of from about one-sixteenth inch per inch to about one-eighth inch per inch of the diameter of said bit.

4. The tri-cone drilling bit of claim 3 in which said cutting elements comprise tungsten carbide grains in a cobalt matrix and the shape of the cutting elements protruding outwardly beyond the cutter surface is substantially conical with a rounded top.

5. The tri-cone drill bit of claim 4 wherein the portion of each cutting element protruding beyond the cutter surface is of generally conical shape and has a rounded tip.

6. The tri-cone drill bit of claim 3 wherein at least one of said cutting elements comprises a tungsten carbide-cobalt insert having a chisel-shaped protruding portion.

* * * * *